United States Patent [19]

Tripp

[11] 4,370,103

[45] Jan. 25, 1983

[54] PISTON PUMP WITH DISCHARGE VALVE, INLET VALVE AND MISALIGNMENT COMPENSATING MEANS IN A PUMP HEAD

[75] Inventor: Dwight E. Tripp, Longview, Tex.

[73] Assignee: Arrowhead Research, Houston, Tex.

[21] Appl. No.: 144,790

[22] Filed: Apr. 28, 1980

[51] Int. Cl.[3] ..... F04B 21/02; F04B 49/02

[52] U.S. Cl. ..... 417/298; 417/558

[58] Field of Search ..... 417/296, 558, 559, 298

[56] References Cited

U.S. PATENT DOCUMENTS

| | | | |
|---|---|---|---|
| 737,809 | 9/1903 | Whitaker | 417/558 |
| 758,183 | 4/1904 | Kryszat | 417/558 |
| 947,536 | 1/1910 | Wenkel | 417/558 |
| 2,327,269 | 8/1943 | Jessup | 417/558 |

FOREIGN PATENT DOCUMENTS

| | | | |
|---|---|---|---|
| 1134166 | 11/1956 | France | 417/558 |

*Primary Examiner*—John J. Vrablik

*Attorney, Agent, or Firm*—Gunn, Lee & Jackson

[57] ABSTRACT

A piston pump mechanism for use in positive pressure and vacuum pumping systems for pumping various gases such as air, freon, natural gas, etc. The pump mechanism incorporates an inlet and discharge valve system that substantially eliminates any unpurged or unswept volume of gas within a pump cylinder during each reciprocating stroke of the pump piston. The pump mechanism also incorporates a control spool that floats within a pump head and has a sealed flexible interconnection with the discharge valve that allows the discharge valve to seek optimum seating engagement about the entire periphery of the cylinder. The valve control spool may be pressure balanced or controllably unbalanced, as desired, for influence of the discharge valve. The spool also provides for inlet of gas to an inlet valve that may be incorporated into the discharge valve.

29 Claims, 16 Drawing Figures

PISTON PUMP WITH DISCHARGE VALVE, INLET VALVE AND MISALIGNMENT COMPENSATING MEANS IN A PUMP HEAD

FIELD OF THE INVENTION

This invention relates generally to a method and apparatus for compression and evacuation of gases, and more particularly to a system pertaining to piston energized transfer of gases during compression or evacuation activities wherein volumetric efficiency of the apparatus is achieved by discharge of substantially 100% of the gas from a cylinder during each compression or evacuation stroke of a piston reciprocating within the cylinder. Even more specifically, the present invention is directed to a combination piston, cylinder and valving arrangement that substantially eliminates any unpurged or unswept volume of gas within a cylinder during each reciprocating stroke of the piston that is moved within the cylinder.

BACKGROUND OF THE INVENTION

In piston type pump apparatus, it is desirable to ensure that no gaseous material is allowed to enter the cylinder and develop a cushion or volume of material which is subject to reexpansion and which interferes with the ability of the pump piston to displace a desired volume of gas during each stroke of the piston. For example, U.S. Pat. No. 2,396,602 of Posch describes the problem of gas interference in liquid pumps. Piston energized pump design for liquids is not typically concerned with problems of unswept or unpurged volume within the cylinder, simply because the liquid material remains substantially incompressible during virtually all phases of liquid pressurization that occurs.

In the case of fluid transfer apparatus that is adapted to transfer gaseous material, such as gas compressors, gas evacuation apparatus, for example, the presence of unswept volumes within a cylinder directly affects the volumetric efficiency of the gas transfer apparatus. During the compression stroke of piston energized gas transfer apparatus, with the piston at top dead center, there typically remains a small unswept or unpurged volume of compressed gas that does not escape through the exhaust valve of the pump. As the piston then begins its intake stroke, the typical pressure energized intake valve is caused to remain closed by the pressurized gas in this unswept volume and the gas merely reexpands during an initial portion of the intake stroke of the piston. After the pressure of the reexpanding unswept volume of gas is depleted, further movement of the piston during the intake stroke will develop a negative pressure within the enlarging cylinder chamber between the piston and valve and this negative pressure will develop a pressure differential across the intake valve, overcoming the usual spring bias of the intake valve and causing it to open. Further movement of the piston during intake stroke will then cause gas to be drawn through the intake valve, thus charging the cylinder with a fresh, uncompressed supply of gaseous material which is then compressed as the piston reverses its direction of movement at bottom dead center and then begins a compression stroke toward top dead center.

Where residual compressed gas remains within the cylinder at the end of a compression stroke, the compressed gas will be rather hot. Subsequent inlet of ambient gas into the cylinder during an intake stroke causes mixing of cool ambient gas with the hot previously compressed gas. The result of such mixing is an increase in the temperature of the ambient gas, thus detracting from the volumetric efficiency of the gas pumping operation. It is desirable to pump ambient gas as cool as possible so as to enhance volumetric efficiency and to avoid mixing of hot gas with cool ambient gas prior to compression thereof.

The net effect of the unswept volume within typical gas compressors, vacuum pumps and the like is continual recompression and reexpansion of the small unswept volume, which exists as a limiting factor on volumetric efficiency. Obviously, the piston energized pump mechanism would be efficient from a volumetric standpoint if the unswept or unpurged volume within the cylinder could be eliminated upon each compression stroke of the cylinder. If this should occur, then no gas reexpansion would occur during an intake stroke and the cylinder would be substantially 100% charged during each intake stroke and substantially 100% discharged at the end of each compression stroke.

From a theoretical standpoint, it may be possible to design a piston energized pump mechanism having cylinder purging that approaches 100%. For example, U.S. Pat. No. 1,137,751 of Gaede discusses the provision of a vacuum pump mechanism wherein a piston that reciprocates within a cylinder is caused to contact an immovable internal wall defined at one extremity of the cylinder. It is well understood that a pump mechanism such as that shown in the patent to Gaede is not commercially feasible since mechanical damage and deterioration would occur each time the moving piston element contacts the immovable end wall of the cylinder. The requirement for manufacturing tolerances would therefore dictate that the end wall of the piston be in spaced relation with the immovable cylinder wall at top dead center, therefore defining a small unpurged volume within the cylinder at top dead center. This unpurged volume, of course, detracts from the volumetric efficiency of the compressor mechanism and the volumetric efficiency of the compressor, therefore, falls off considerably as the maximum pressure of the unit increases.

Other compressor systems have been developed for the purpose of achieving substantially complete purge of gas at each compression stroke of the piston. For example, U.S. Pat. Nos. 600,841 of Oderman; 1,488,683 of Juruick; 947,536 of Wenkel; and 2,327,269 Jessup each teach the provision of discharge valve elements that seal about the entire periphery of the cylinder. Further, the Oderman and Jessup patents teach the provision of an inlet valve of the poppet valve type which is incorporated within the discharge valve. The patent of Wendel teaches the use of a reed type inlet valve which is also incorporated within a reed or flexible plate type discharge valve. Although these valves, from a theoretical standpoint, are capable of achieving complete purging of the cylinder at each compressive stroke of the piston, in order to accomplish sealing of the discharge valve with respect to a sealing surface formed about the cylinder, it is necessary that the cylinder bore and discharge valve seat be precisely oriented with respect to one another. Precision machining of this nature is extremely difficult to accomplish and therefore results in extremely high manufacturing costs. Further, it is also necessary that the discharge valve and the bore within which the discharge valve reciprocates, be accurately machined and precisely aligned with respect to the bore of the cylinder and the discharge valve sealing surface at the end wall of the cylinder. Again, such machining operations are extremely difficult and expensive to accomplish and thereby detract from the commercial feasibility of compressor systems of this nature.

Under circumstances where discharge valve sealing is accomplished about the entire periphery of the cylinder, it is, of course, required that the discharge valve be of larger diameter than the cylinder. The discharge valve is, therefore, of quite large and heavy construction, especially where the compressor system is adapted for high pressure pumping operations, and therefore, the discharge valve mechanism has sufficiently high inertia as to detract materially from the operational capability thereof. For efficient high speed pumping operations, it is desirable that the discharge valve have low inertia characteristics in order that it be enabled to move rapidly and efficiently responsive to appropriate pressure conditions within the cylinder and discharge chambers.

In many cases where high pressure compressor operation is required and where large volumes of compressed gas may be required intermittently, it is difficult and expensive to provide compressor power systems having the capability of initiating compressor operation under high pressure load. For this example, it is desirable in many cases to provide a feature typically referred to as suction unloading, which allows the power system to start or remain operating under little or no load. After the power system has been energized and reaches operational capability, the suction unloading system is inactivated, thereby allowing the operating power system to become loaded while operating normally. This feature allows the design of the power system to be of smaller magnitude and therefore typically of less expensive nature and generally prevents premature deterioration of the compressor power system. When a compressor is operating and the receiver tank reaches its maximum desired pressure, it is common to diminish or cease the compressor's pumping ability while maintaining its operational RPM. This is accomplished by the suction unloading process and the resulting energy consumed is lessened considerably with a totally unloading compressor requiring only the energy necessary for its mechanical friction. As the compressor unit increases in size, the more economically favorable it becomes to allow it to remain at operational RPM without pumping rather than to restart it from rest, as required. In the case of compressor systems incorporating discharge valves that seal about the entire periphery of the cylinder and especially under circumstances where the discharge valve and inlet valves are incorporated in a single mechanical unit, it is extremely difficult to accomplish suction unloading. It is therefore desirable to provide a compressor system having the capability of accomplishing substantially 100% purging of the compressor cylinder at each compression stroke and yet achieve suction unloading under circumstances where such is desirable.

In view of the foregoing, it is a primary feature of the present invention to provide a novel gas pump system for positive pressure and vacuum application which has the capability of accomplishing 100% purge of the cylinder at each compression stroke thereof and thereby avoids gas reexpansion within the cylinder which otherwise would interfere with the volumetric efficiency thereof.

It is also a feature of this invention to provide a novel gas pumping mechanism wherein virtually no residual compressed heated gas is allowed to remain in the pump cylinder at the end of a compression stroke and thus mixing of heated gas with cool ambient gas does not occur.

It is another feature of this invention to provide a novel gas pumping mechanism wherein the discharge valve provides an unrestricted opening that minimizes resistance to discharge and therefore also minimizes the pressure induced force acting on the piston.

It is another feature of this invention to provide a novel compressor mechanism incorporating a compressor head structure that accommodates angular and lateral misalignment of parts and promotes efficient sealing of the discharge valve regardless of such lateral and angular misalignment.

It is an even further feature of this invention to provide a novel gas compressor mechanism incorporating a discharge valve construction of low inertia characteristics which will function efficiently under high speed compressor operation.

Among the several features of this invention is noted the provision of a novel gas compressor construction which incorporates a floating discharge and inlet valve assembly that defines a plane at the end of the cylinder when seated thereon and wherein the end wall of the piston of the compressor mechanism is adapted to move beyond this plane to a top dead center position.

It is an even further feature of this invention to provide a novel compressor mechanism incorporating a discharge valve that is lifted from its seated relationship by means of a cushion of compressed gas driven by the piston of the compressor and wherein the discharge valve achieves 360° exhaust of compressed gas into the discharge chamber of the compressor mechanism.

It is an even further feature of this invention to provide a novel compressor mechanism wherein seating of the discharge valve about one end of the cylinder of the compressor is achieved by the force of mechanical urging means and wherein discharge valve positioning and control is assisted by means of a pressure balanced control device.

Another feature of this invention concerns a gas pumping mechanism incorporating a discharge valve and control device that is capable of functioning in any one of several conditions including pneumatically unbalanced, mechanically induced and pneumatically induced.

It is also a feature of this invention to provide a novel gas compressor mechanism incorporating a discharge valve control spool assembly which is sealed with respect to a compressor head structure by O-ring type seals that have rolling rather than sliding characteristics to enhance the functional sealing life thereof.

It is another feature of this invention to provide a novel gas pumping mechanism incorporating a discharge valve control spool assembly which may be sealed with respect to a pump head by suitable sealing means including metal diaphragms, sliding seal elements and the like.

Other and further objects, advantages and features of the present invention will become apparent to one skilled in the art upon consideration of this entire disclosure. The form of the invention, which will now be described in detail, illustrates the general principles of the invention, but it is to be understood that this detailed description is not to be taken as limiting the scope of the present invention.

SUMMARY OF THE INVENTION

A gas compressor mechanism constructed in accordance with the present invention is enabled to function efficiently under positive pressure and vacuum pumping operations and achieves optimum volumetric efficiency by accomplishing substantially 100% purging of the cylinder. The volumetric efficiency is further enhanced by providing a discharge valve that seals about the entire periphery of the cylinder and which is capable of accomplishing discharge of gas about the entire periphery thereof while requiring only a minimal amount of movement and time to accomplish complete discharge of gas into an annular discharge chamber that is provided about the entire periphery of the discharge valve.

Even further enhancement of the volumetric efficiency of the compressor mechanism is accomplished by providing a discharge valve system of low inertia characteristics thereby providing that the discharge valve system is effectively responsive to gas pressure seating and unseating. Since minimal discharge valve movement occurs upon unseating at discharge, it is logically at close proximity to the valve seat even when fully open. Seating of the discharge valve therefore occurs upon minimal travel to the seated position thereof and the inertia of the discharge valve is therefore also minimal. The discharge valve is, therefore, capable of traveling with the piston and reaching the transverse plane of the cylinder substantially simultaneously with the end wall of the piston. Thus, virtually no gas remains between the discharge valve and the end wall of the piston at initiation of the intake stroke and therefore charging of the cylinder with ambient gas begins immediately upon seating of the discharge valve.

Although within the scope of this invention, the gas inlet valve may be provided at locations other than in the discharge valve system, for the sake of simplicity and commercial feasibility, the inlet valve system is shown to be incorporated within the discharge valve mechanism. For example, as an alternative, the pump cylinder may be provided with a valve-controlled inlet port through which ambient gas is introduced into the cylinder under the influence of piston-induced suction. As another alternative, the piston could be provided with an inlet valve and air can be introduced into the cylinder from the crank case of the pump. The discharge valve mechanism comprises a valve plate structure having sealing capability about the entire periphery of the cylinder. A valve controlling spool is movably positioned within a spool receptacle defined within a compressor head structure. An operative relationship is established between the valve plate and spool by means of plate centering means that allows the valve plate to seek optimum alignment and seating with respect to a seating surface defined about the cylinder without regard to axial alignment between the valve control spool and the cylinder. The valve centering means gives the discharge valve plate a floating capability within the compressor head to compensate for inaccuracies in orientation of various critical surfaces that occur due to the rather wide manufacturing tolerances that are allowable by virtue of the compressor design. The valve centering means, which also has sealing capability, functions to seal an inlet chamber defined within the valve control spool from the valve discharge chamber. Inlet of gas into the inlet chamber is established by providing an inlet supply chamber in the compressor head which is communicated with the inlet chamber of the valve control spool and sealed with respect to the discharge chamber by suitable sealing means. An inlet valve is supported by the valve plate and is capable of moving between open and closed positions with respect to an inlet valve seat defined in the discharge valve plate in response to pressure differential that is developed during the suction and discharge strokes of the compressor mechanism.

The discharge valve mechanism may be pressure balanced, if desired, or, in the alternative, may be unbalanced and selectively urged in a desirable direction responsive to the pressure of compressed gas within the discharge chamber. This feature is accomplished by providing the discharge valve control spool with suitable pressure responsive areas and by communicating discharge pressure to each extremity of the spool to develop balanced or unbalanced force activity in response to communication of equal discharge pressure to the opposed pressure responsive areas of the spool. The valve control spool is also responsive to mechanical force developed by a compression spring, which urges the spool in the direction to accomplish seating of the discharge valve plate about the cylinder.

In one embodiment of the invention, the top dead center position of the piston is such that the flat end wall of the piston is positioned slightly beyond the discharge extremity of the cylinder, thus providing that discharge valve displacement must occur in order for the piston to reach the top dead center position. In an alternative embodiment, the piston end wall may be designed to place the flat end wall thereof in registry with the transvere plane of the end of the cylinder or in spaced relation with such plane, as desired. In either case, as the piston nears the terminal portion of its discharge stroke, discharge valve movement is delayed until such time as the end wall of the piston nears the discharge extremity of the cylinder. The discharge valve then opens suddenly, responsive to gas pressure differential and remains separated from the end wall of the piston by a diminishing cushion of gas that is present between the discharge valve and piston. As this cushion of gas dissipates, the piston will have moved to its top dead center position, where its velocity is zero and then will begin to move in the opposite direction as the inlet or suction stroke is initiated. The discharge valve will follow the piston during the initial portion of the inlet stroke until such time as the peripheral portion of the discharge valve contacts the sealing surface of the cylinder body and thereafter, continued movement of the piston in the intake direction will result in pressure responsive opening of the inlet valve and inlet of ambient gas into the cylinder.

The pumping mechanism incorporates a valve control spool which is adapted for reciprocal movement with a pump head and which cooperates with the discharge valve to define a universally movable engaged relation therebetween which allows the discharge valve to float and seek optimum engaging relation with the valve seat. This omnidirectional freedom of movement of the discharge valve effectively compensates for angular and lateral misalignment of the spool bore of the pump head with respect to the axis of the cylinder and allows efficient valve seating to occur. The universally movable engaged relation between the discharge valve and the valve control spool is established by an annular resilient member that also maintains a seal between the discharge valve and spool. The piston pump mechanism of the present invention is effectively usable in both gas compression and vacuum pumping systems and is also capable of being employed in single stage compressor systems and in compressor systems incorporating multiple stages. The compressor mechanism is also capable of being employed under circumstances where unloading systems are incorporated to permit initiation of compressor operation under load and to allow reduced pumping operation at a given RPM.

BRIEF DESCRIPTION OF THE DRAWINGS

So that the manner in which the above-recited features, advantages and objects of the present invention, as well as others which will become apparent, are attained and understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of the invention and are therefore not to be considered limiting of its scope, for the invention may admit to other equally effective embodiments.

In the drawings:

FIG. 1 is a partial isometric view of a piston pump mechanism constructed in accordance with the present invention, and illustrating a compressor head mechanism being interconnected with a compressor body by a plurality of exposed bolts.

FIG. 2 is a partial isometric view of a piston pump mechanism, constructed in accordance with the present invention, and illustrating an alternative pump head mechanism being interconnected by any suitable means to a pump body.

FIG. 3 is a schematic illustration of a gas pumping system constructed in accordance with the present invention and illustrating a suction unloading system that allows continuous operation of the gas pumping mechanism while allowing the pump mechanism to be unloaded in response to pressure within a receiving vessel.

FIG. 4 is a sectional view of a piston pump mechanism constructed in accordance with this invention and illustrating the position of the various parts thereof during the inlet or suction stroke.

FIG. 4A is an enlarged fragmentary sections view of the discharge plate and spool of FIG. 4 illustrating the relation of the sealing member therewith.

FIG. 5 is a sectional view of a piston pump mechanism similar to that of FIG. 4 and illustrating the position of the various parts thereof during the compression stroke.

FIG. 6 is a sectional view similar to that of FIGS. 4 and 5 and illustrating the position of the various moving parts thereof at opening of the discharge valve during the latter stage of the compression stroke.

FIG. 6A is a fragmentary sectional view of the pump head and valve controlling spool of a modified embodiment incorporating spool seals of differing diameter for pressure induced directional control of the spool.

FIG. 6B is a fragmentary sectional view of a further embodiment similar to that of FIG. 6A but illustrating pressure induced directional control of the valve controlling spool in a direction opposite to that of FIG. 6A.

FIG. 7 is also a sectional view of the gas pump mechanism of FIGS. 4–6 and illustrating the position of the various moving parts thereof at the top dead center position of piston movement.

FIG. 8 is a sectional view of a piston pump mechanism representing a modified embodiment of this invention incorporating a reed valve system as the inlet or suction valve.

Figure 8:
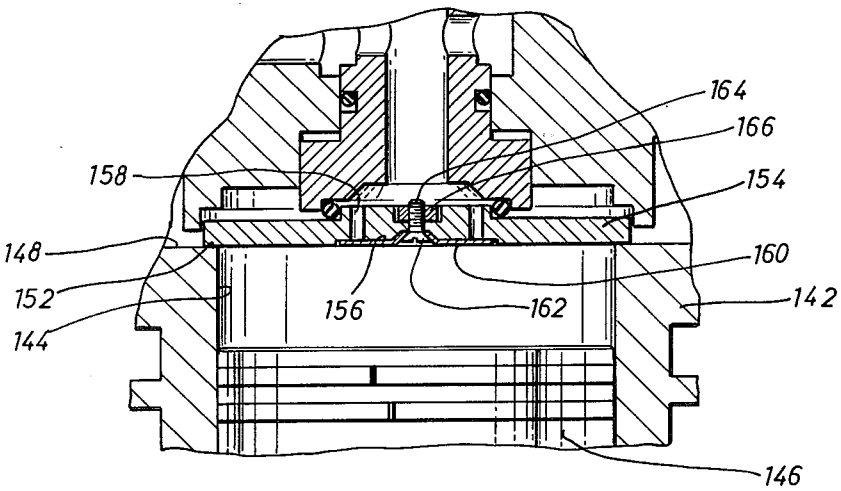
Figure 8A:
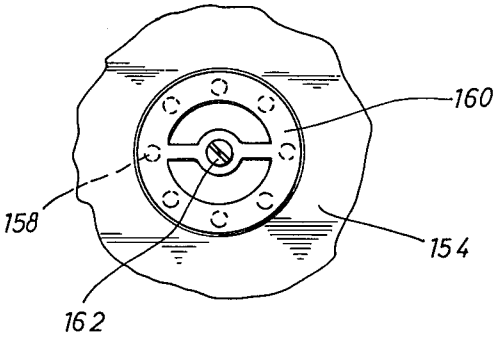

FIG. 8A is a bottom view taken within the cylinder and above the piston and illustrating the circular inlet valve of FIG. 8 in detail.

Figure 9:
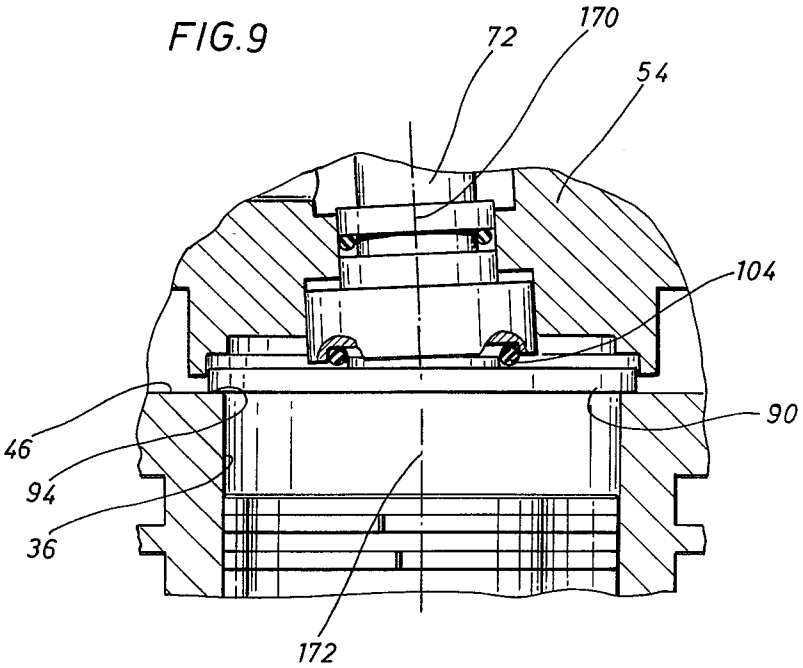

FIG. 9 is a sectional view of a piston pump mechanism such as that of FIGS. 4–7, with the mechanism being distorted to illustrate compensation of the discharge valve mechanism for misalignment with the piston bore due to manufacturing tolerances.

Figure 10:
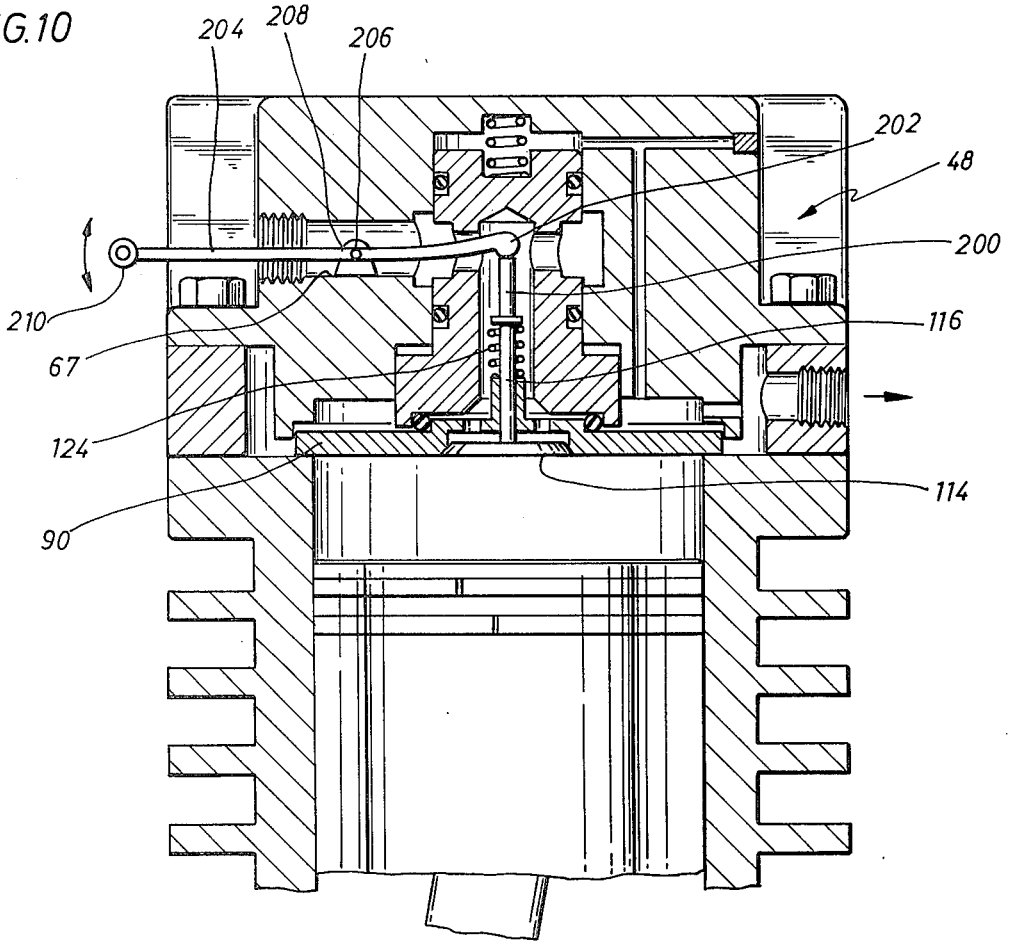

FIG. 10 is a sectional view of a piston pump mechanism constructed in accordance with the present invention and illustrating a mechanical unloading system being incorporated therewith and representing a further modified embodiment of the present invention.

Figure 11:
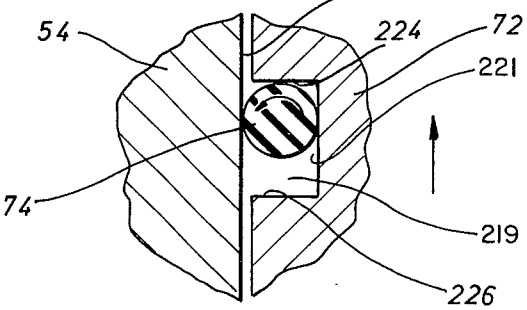

FIG. 11 is a fragmentary sectional view of a portion of the piston pump mechanism of FIGS. 4–7 and illustrating the nature of the seal construction that establishes sealing between the discharge valve control spool and the compressor head and facilitates extended service capability thereof.

Figure 12:
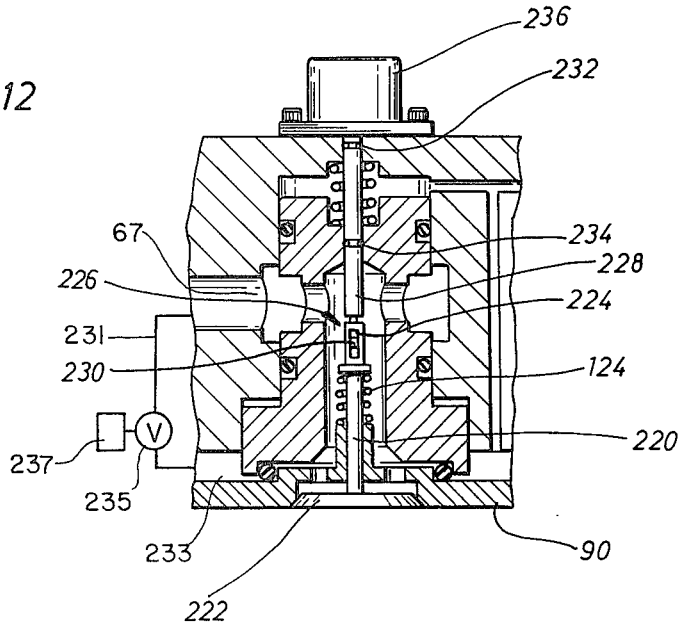

FIG. 12 is a fragmentary sectional view of an alternative embodiment of this invention wherein suction unloading is accomplished by a mechanism that prevents sealing of the discharge valve.

DETAILED DESCRIPTION OF PREFERRED EMBODIMENT

Figure 1:
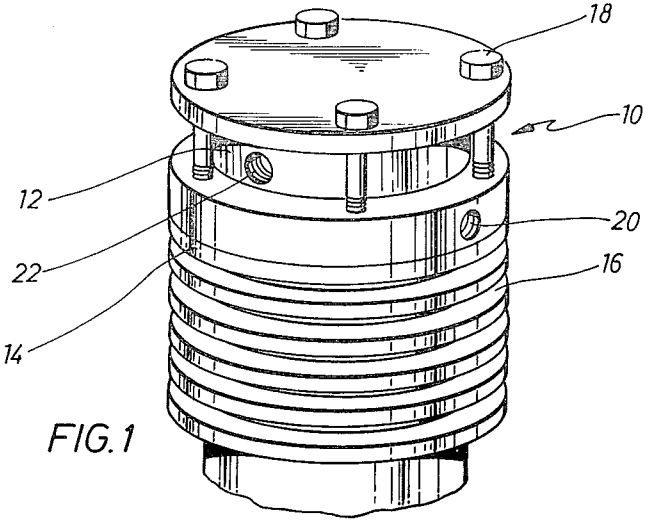

Referring now to the drawings and first to FIG. 1, a piston pump mechanism constructed in accordance with the present invention is illustrated generally at 10 which incorporates a compressor head structure 12 which is retained in assembly with the free extremity 14 of a pump body 16 by means of a plurality of bolts, cap screws or the like 18. The pump head structure is formed to define an inlet opening 22 through which ambient gas is drawn into the head structure by suction during the inlet stroke of the pump piston and is also formed to define a discharge opening 20 through which pressurized gas is discharged from the pump head structure. When the pump mechanism of FIG. 1 is employed for the purpose of gas compression, a suitable conduit, not shown, will be interconnected with the head structure at the discharge opening 20 thereby providing a discharge conduit to conduct compressed gas to a suitable facility for accomplishing work. In this circumstance, a filter mechanism, not shown, will be interconnected with the inlet or suction opening 22 to ensure that abrasive particulate, such as sand, dirt, etc., is not drawn into the cylinder during operation.

Figure 2:
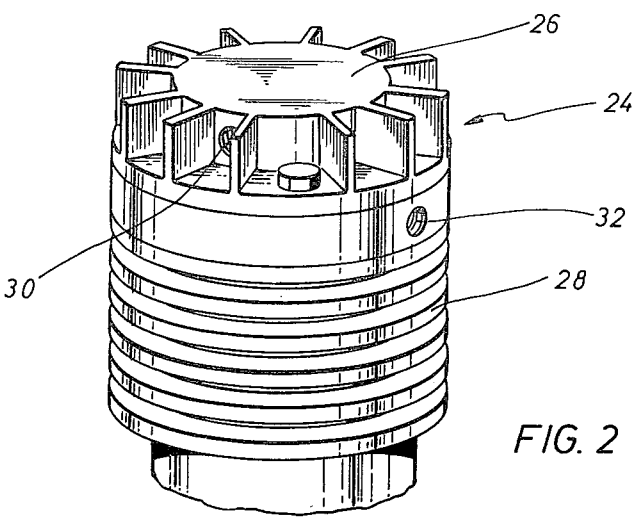

With reference to FIG. 2, another embodiment of the present invention is shown generally at 24 which incorporates a pump head structure 26 that is interconnected with the discharge extremity of a pump body 28 by bolts, screws or any other suitable means of connection. The pump head structure of FIG. 2 represents a more commercially acceptable embodiment as compared to that of FIG. 1, but the structure and function of the various internal parts thereof may be substantially identical, if desired.

Referring now to the FIGS. 4–7, the present invention may conveniently take the form particularly illustrated therein wherein a pump body structure 34 is provided which is formed to define a piston bore 36 having a piston 38 disposed therein for reciprocation by means of a connecting rod 40 that is suitably interconnected with a conventional crank assembly that converts rotational movement of a crankshaft into linear reciprocation of the piston element 38 within the cylinder. A sealed relationship is maintained between the piston and cylinder wall by piston seal elements 42. The pump or cylinder body 34 is formed at the upper extremity thereof to define a connection flange portion 44 defining an annular planar surface 46 against which is seated a valve head structure illustrated generally at 48. The valve head may be secured to the pump body by any suitable means such as bolting, clamping, etc., without departing from the spirit and scope of this invention. A head support element 50 is interposed between the connection flange 44 of the pump body 34 and a retainer flange portion 52 of a pump head structure 54. The head support element 50 cooperates with the head structure to define a peripheral discharge chamber 56 that is in communication with a discharge passage 58 through which compressed gas is conducted from the discharge chamber to a discharge conduit 60 which is interconnected with the support element 50 by means of a threaded connection fitting 62 as shown or by any other suitable form of connection. If desired, the pump head may be an integral structure with element 50 being an integral part thereof and with the discharge chamber 56 being machined or otherwise formed therein.

It is desirable to provide the pump head structure 54 with a discharge valve and valve control mechanism and with an inlet valve and valve control mechanism. These features are conveniently accomplished in accordance with the present invention by forming the pump head structure to define a blind bore 64 having an enlarged portion 66 intermediate the extremities thereof thereby partitioning the bore 64 into spaced cylindrical sealing surface portions 68 and 70. An elongated spool element 72 is received within the spool receptacle defined by the bore 64 and is sealed with respect to sealing surfaces 68 and 70 by means of annular sealing elements 74 and 76. The sealing elements 74 and 76 have a particular sealing relationship with the respective sealing surfaces 68 and 70 for the purpose of promoting extended service life of the sealing capability thereof. This feature will be discussed in detail hereinbelow in connection with FIG. 11.

The spool element 72 is positioned for reciprocating movement within the bore 64 with upward movement of the spool being limited by means of a positive stop that is defined by an internal shoulder 78 which is defined by a yet further enlarged portion 80 of the bore 64. Sufficient clearance exists between the spool and the internal cylindrical surface 80 to prevent any volume of gas being trapped in the annular space between surfaces 78 and 82. An annular shoulder surface 82 defined at the lower portion of the spool 72 is adapted to contact the stop surface 78 to limit upward travel thereof. The spool element is urged downwardly by the force of a compression spring 84 which is cooperatively received within spring receptacles 86 and 88 that are defined respectively within the head structure 54 and the spool 72. The spool 72 provides a controlling function for a discharge valve 90 that is formed to define a peripheral sealing surface 92 that is adapted for sealing engagement with an annular seating surface 94 that is defined about the periphery of the cylinder wall 36. Although the seating surface 94 may take any other suitable form within the scope of this invention, as shown in FIGS. 4–7, seating surface 94 is defined at the inner peripheral portion of the annular planar head support surface 46. The annular sealing surface 92 of the discharge valve 90 is also of planar annular form and is adapted to establish optimum sealing engagement with the seating surface 94 as is appropriate to efficient operation of the gas pumping mechanism. The lower portion of the head structure 54 is formed to define an annular retainer rim 96 of sufficient internal diameter that the outer peripheral surface of the discharge valve 90 is received in loose fitting relationship therein. The annular rim structure 96 functions to prohibit unusual lateral shifting of the discharge valve. The annular rim is disposed in spaced relation with the planar surface 46 of the flange 44 and cooperates therewith to define an annular discharge path past the discharge valve 90 into the annular discharge chamber 56. As the piston element 38 moves toward the discharge valve, pressure within the cylinder 36 increases and causes unseating of the discharge valve 90. The compressed gas is allowed to flow through the clearance that develops between the discharge valve and the seating surface 94, thus causing full 360° discharge of gas from the cylinder into the annular discharge chamber 56. By virtue of the occurrence of 360° discharge of compressed gas into the discharge chamber, the discharge valve 90 need move only slightly in order to accomplish complete and efficient discharge of gas into the discharge chamber. Movement of the discharge plate is generally proportional to cylinder displacement. For example, a cylinder having a bore of 1.750 inches and a stroke of 2.000 inches will normally have a discharge plate displacement of about 0.010 of an inch.

In one valid perspective, a pneumatic gas compressor can be considered a pneumatic shock absorber because a high volume of compressed gas is forced at relatively high velocity through an orifice (the discharge valve). The discharge valve typically defines a small area relative to the cylinder volume and the time required for the contents of the cylinder to be forced through the orifice. Logically, the "shock absorber" effect typically worsens as discharge pressure increases. Moreover, there is a certain amount of energy lost to heat as the result of the shock absorber effect with a resultant lowering of volumetric efficiency.

In the case of the present invention, however, the discharge port circumscribes the entire cylinder and the discharge valve is enabled to open as much as necessary to ensure that back pressure is minimized and thus shock absorber effect is minimized.

It is desirable to ensure that the discharge valve 90 remains substantially centered in relation to the seating surface 94, and it is further desirable that the discharge valve be capable of floating and seeking an optimum seating relationship with the seating surface regardless of any misalignment that might be present due to inaccuracies resulting from the manufacturing process. For example, it is extremely difficult to machine the planar support surface 46 of the flange 44 in precisely normal relationship with the center line of the cylinder bore 36. It is also extremely difficult to machine the blind bore 64 in the pump head structure 54 in such manner that the axis of the bore 64 is in precisely coaxial relation with the center line or axis of the cylinder 36. Under circumstances where these cooperating bores are slightly misaligned or disposed in slight angular relation, it is desirable that the discharge valve 90 be capable of overcoming these structural disadvantages and establishing optimum sealing relationship with the seating surface 94. In accordance with the present invention, the discharge valve 90 is provided with a floating capability, independent of the valve control spool 72. The valve control spool is formed at the lower extremity thereof to define an annular retainer rim 98 and rim 98 cooperates with an annular shoulder 100 defined by the discharge valve to form a circular receptacle 102. A circular sealing element 104 such as an O-ring or the like composed of elastomeric material is receivable within the annular receptacle 102 and is engaged both by the discharge valve and spool, such that the sealing element maintains a sealed relationship with respect to the discharge valve and spool. Although the annular sealing element 104 provides a sealing function, it should also be borne in mind that the sealing element provides a centering function for the discharge valve as well. Since the sealing element is composed of an elastomeric material, the discharge valve is allowed to shift laterally but, upon such shifting, the sealing element is slightly compressed on one side thereof, developing a resultant force that tends to shift the discharge valve back to a centered relationship with respect to the spool. This feature provides the discharge valve with the freedom to float as required for optimum pressure responsive movement thereof and yet prevents excessive shifting of the discharge valve which might occur if the discharge valve were complete uncontrolled.

In addition to providing a sealing and centering function with respect to the discharge valve and spool, the annular sealing element 104 also compensates for any misalignment that might exist between the center lines of the piston bore and spool. If the center lines of the piston bore and spool are precisely coincident, the planar end surfaces of the spool will be precisely parallel with respect to the plane defined by the sealing surface 94 and the discharge valve 90 will have optimum seating relationship both with the sealing surface 94 and with the end surfaces of the spool. As is typically the case, it is extremely difficult to provide opposed separately machined bores having the center lines thereof precisely coincident. In the event of slight angular misalignment between the center lines of the piston bore and spool or spool receptacle of the head, the annular sealing element 104 is capable of being compressed to a greater extent on one side as compared to the opposite side thereof. This feature allows the discharge plate valve 90 to be positioned in slightly angulated relationship with the spool and spool receptacle and yet allows proper seating relationship to occur between the discharge valve and the annular seating surface 94.

It is desirable to provide the gas pumping mechanism with an inlet valve without requiring modification of the cylinder or piston structures. This feature is effectively accomplished in accordance with the present invention by providing an inlet valve in the discharge valve structure in the manner illustrated particularly in FIGS. 4–7. The spool structure 72 is formed to define an internal blind bore 106 that extends centrally from the lower portion of the spool as shown. The bore 106 is intersected by a transverse bore 108 which is located between the respective sealing elements 74 and 76 and is in communication with the annular inlet chamber 66. As gas flows through the inlet passage 67 into the inlet chamber 66, the transverse bore 108 allows flow of gas from the chamber 66 into the blind bore 106. It should be borne in mind, however, that the cylinder and/or piston structures may also be modified within the scope of this invention to accomplish the intended purposes.

Figures 4, 4A, 5:
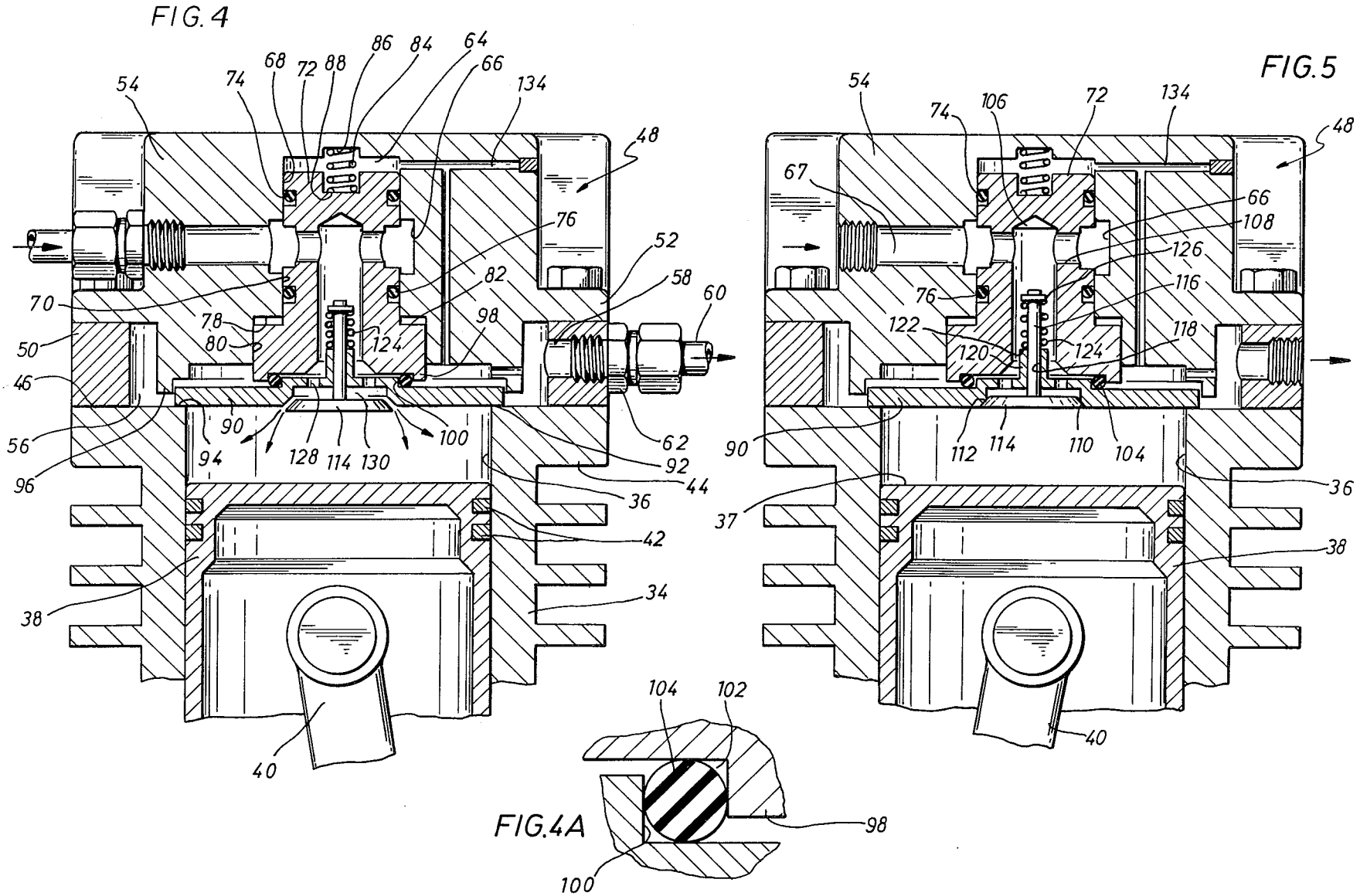

The discharge valve 90 is formed to define an annular tapered valve seat 110 that is engaged by a correspondingly tapered sealing surface 112 defined on a poppet type inlet valve 114. The inlet valve is formed to define a valve stem 116 that extends through a stem passage 118 defined by an upstanding portion 120 of the discharge valve 90. The upstanding portion or boss 120 defines a spring support shoulder 122 that is engaged by the lower portion of a compression spring 124. The upper extremity of the compression spring is restrained by a retainer element 126 that is received within an appropriate groove defined at the upper end of the valve stem 116. The compression spring 124 functions to maintain the poppet valve 114 in the closed or seated position thereof against the tapered annular sealing surface 110 in absence of any pressure influence acting thereon. As the piston element 38 moves downwardly as shown in FIG. 4 during the inlet stroke thereof, a depressed pressure condition is developed within the cylinder 36 thereby causing a pressure differential to exist across the inlet valve 114. This pressure differential, acting downwardly against the inlet valve, causes the inlet valve to open as shown in FIG. 4, thereby allowing flow of gas from the blind bore 106 and through a plurality of apertures 128 defined in the discharge valve 90 and opening into a chamber 130 within which the inlet valve is received. As the inlet valve 114 moves downwardly under the influence of differential pressure as shown in FIG. 4, the compression spring 124 is compressed. After termination of the inlet stroke of the piston, the pressure condition within the cylinder 36 will return to substantially ambient conditions thereby dissipating the differential pressure existing across the inlet valve. Naturally, in the case of multistage compression, the ambient pressure of a later stage is the discharge pressure of the preceeding cylinder. The compression spring 124 will then shift the inlet valve 114 to the closed position thereof against the tapered seat surface 110.

As shown in FIG. 5, the piston 38 is being moved upwardly during the compression stroke causing gas entrapped within the cylinder 36 to become compressed as the volume of the cylinder is diminished by movement of the piston end wall 37 toward the discharge valve 90. In this case, the inlet valve 114 will be closed not only by the force induced by compression spring 124 but also by virtue of the pressure differential that has developed as the pressure within cylinder 36 increases during the compression stroke. The discharge valve 90 will remain seated during most of the compression stroke by virtue of being urged to the closed position thereof by the compression spring 84 acting upon the spool 72 which, in turn, applies a compressive force through the annular sealing and centering element 104 to the discharge valve. Discharge pressure in this condition acts to close the discharge plate and to balance the control spool 72.

Figure 6B:
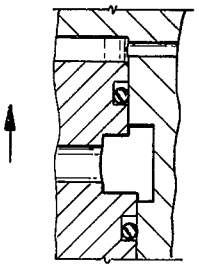
Figure 6:
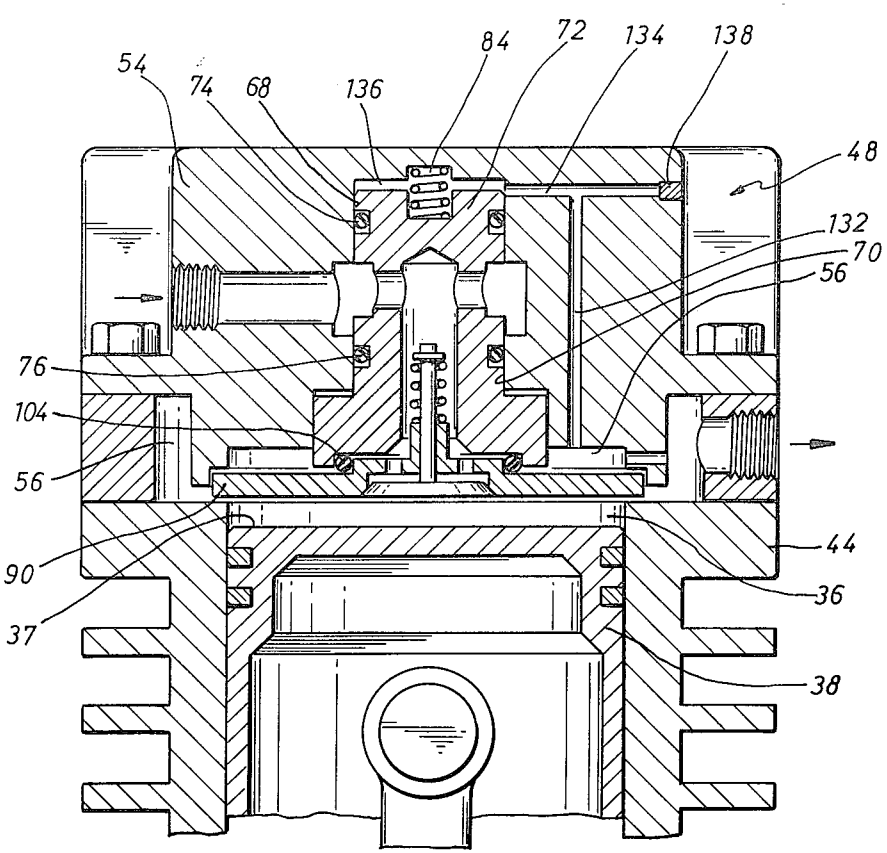
Figure 6A:
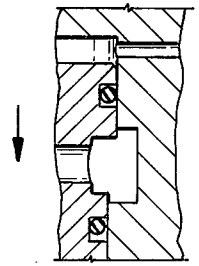

Referring now to FIG. 6, the pump mechanism 48 is illustrated at the discharge position with the end wall 37 of piston 38 being disposed in close proximity to the plane established by the annular seat surface 94 and end wall surface 46 of the pump body. As the pressure within the cylindrical chamber 36 increases to the discharge pressure preset by the compression spring 84, the discharge valve 90 shifts suddenly to the full open position thereof and thereby provides complete 360° discharge of compressed gas from the chamber 36 into the discharge chamber 56 that surrounds the discharge valve. By virtue of the 360° discharge opening defined as the discharge valve 90 shifts upwardly as shown in FIG. 6, discharge of gas into the discharge chamber will occur with minimal movement of the discharge valve. Further, this 360° discharge opening defined by the discharge valve provides substantially unrestricted discharge of gas from the piston chamber 36 into the discharge chamber, thereby further enhancing the volumetric efficiency of the gas pumping mechanism.

One of the important features of the present invention is the low inertia characteristics of the discharge valve which allows the volumetric efficiency of the pumping mechanism to be free of substantial interference by the mass of the discharge valve controlling mechanism. In comparison to the physical pressure responsive dimension of the discharge valve, it is of quite light-weight construction, being in the simple form of a plate valve which is subject to pressure acting upon a discharge valve dimension at least as great as the dimension of the cylinder bore. Moreover, the discharge valve plate 90 is allowed a certain degree of movement relative to the valve control spool structure 72 because the sealing element 104 is composed of elastomeric material that is compressed as the discharge valve plate moves upwardly relative to the spool. In other words, the discharge valve 90 is enabled to begin upward and thus opening movement before upward spring compressing movement of the valve control spool is initiated. This feature effectively overcomes the disadvantages of many former valve and valve control designs where the discharge valve itself was of substantial mass and was thus rendered extremely slow in pressure induced response. For example, U.S. Pat. No. 1,488,683 of Juruick includes a discharge valve structure of extremely great mass, the inertia of which obviously interferes with the volumetric efficiency of the pumping mechanism.

At this point, it should be noted that the spool and discharge plate mechanism of the present invention may be of pressure balanced nature under discharge pressure, if desired, or, in the alternative, the spool may be subject to designed pressure influence if desired for the particular pumping operations involved. The head structure 54 of the pumping mechanism is formed to define interconnecting pressure balancing passages 132 and 134 that communicate a pressure balancing chamber 136 with the annular discharge chamber 56. Thus, as pressure is generated within the discharge chamber, this same pressure is transmitted to the pressure balancing chamber 136 and caused to act upon a cross-sectional area of the spool 72 that is defined by annular sealing contact of the sealing ring 74 with the cylindrical surface 68. Likewise, at discharge, pressure within the discharge chamber 56 acts upon the cross-sectional dimension defined by annular sealing contact between sealing element 76 and the annular sealing surface 70. The discharge pressure in the cylinder of the pump also acts on the discharge valve and develops a pressure induced force which is transmitted through the sealing element 104 to the spool 72. Thus, the valve control spool 72 is pressure balanced when the discharge valve 90 is open. When the discharge valve is closed and the cylinder pressure is negative, such as during the suction stroke, the valve control spool will be unbalanced and will be urged downwardly by pressure acting against a greater upper surface thereof as compared with pressure acting against the lower surface area thereof. The balanced or unbalanced condition of the spool element is therefore dependent on the pressure condition within the cylinder. Since the sealing surfaces 68 and 70 are of identical dimension, discharge pressure acting upon identical cross-sectional dimensions develops a resultant force of zero. Since the spool is pressure balanced at discharge, it is responsive when the discharge valve is open, solely to the force developed by the compression spring 84. To open the discharge valve it is necessary to overcome the discharge pressure induced force that maintains the discharge valve closed together with the discharge valve spring force. After the discharge valve has opened, it is subject only to the force of the rather small spring 84. It is not necessary therefore to continuously apply large magnitude opening force to the discharge valve to maintain it open. This feature minimizes energy loss during pumping operations and facilitates efficient, low-cost pumping. It should be noted also that the pressure balancing passage 134 is closed to the atmosphere by means of a plug 138. In the event it is desired to render the valve controlling spool 72 responsive to unbalanced pressure conditions this may be accomplished simply by causing the sealing dimensions of sealing elements 74 and 76 to be of different character at discharge. Under circumstances where the sealing element 74 and surface 68 are of larger dimension as compared to sealing element 76 and surface 70, discharge pressure acting upon the larger upper dimension will develop a pressure induced resultant force at discharge, action in the downward direction which is in addition to the force developed by the compression spring 84. If the lower sealing element 76 and its sealing surface 70 is of larger dimension as compared to sealing element 74 and surface 68, then, at discharge an upward pressure induced resultant force will be developed which will cause the spool 72 to be urged downwardly against the compression of spring 84 in the manner illustrated in FIG. 6B.

Figure 7:
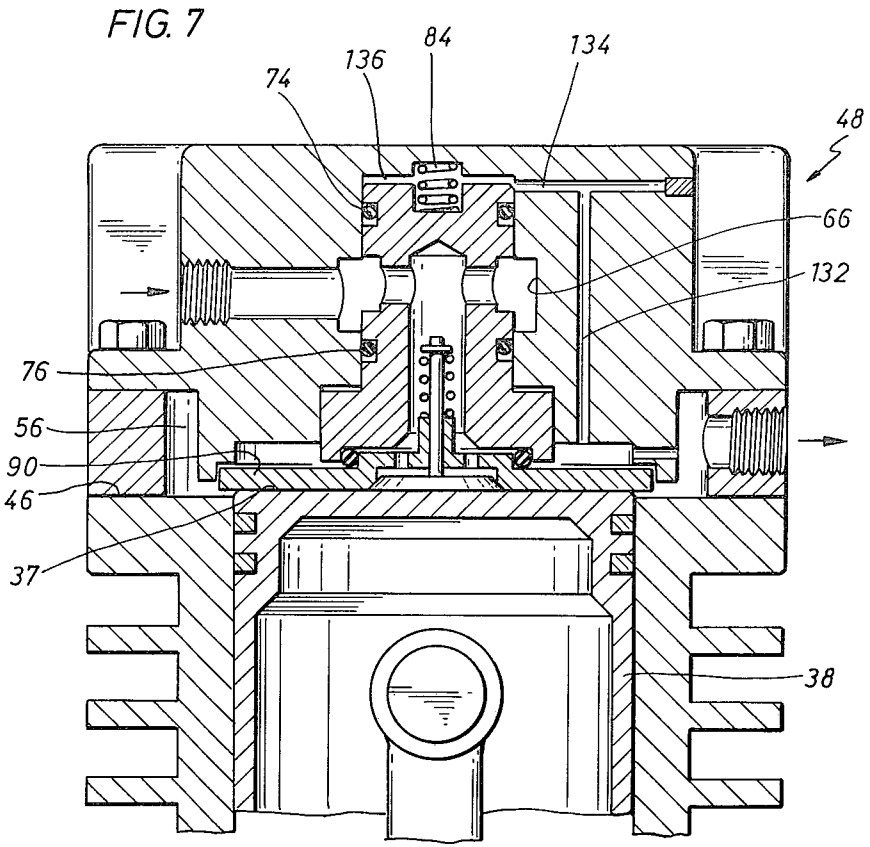

Referring now to FIG. 7, the pump mechanism 48 is illustrated with the piston 38 at the top dead center position thereof. In this position it should be noted that the end wall 37 of the piston has traversed the plane defined by the planar surface 46 and the end wall 37 is shown in substantial contact with the lower planar surface of the discharge valve 90. As the piston 38 moves to the top dead center position, the discharge valve 90 will be raised to its discharge position by virtue of the force induced to it during discharge of gas into the discharge chamber 56. As the end wall 37 of the piston moves into substantial contact with the lower planar surface of the discharge valve and inlet valve, a cushion of gas is present between the opposed planar surfaces of the piston, discharge valve and inlet valve. This cusion of gas then dissipates peripherally into the discharge chamber and allows the discharge valve to come into substantial contact with the end wall of the piston with slow and cushioned relative movement. In this condition it should be noted that the speed of the piston is approaching zero and slamming or impacting contact between the piston and discharge valve is prevented by the cushion of gas. In fact, the cushion of gas may not be completely dissipated between the piston and discharge valve before the piston begins its downward movement at the beginning of an intake stroke. It is possible that the discharge valve and piston may not actually come into physical contact during pumping operations because there always remains some residual cushion of a gas between them even when the discharge valve becomes seated against the annular seat surface 94 at the beginning of the inlet stroke of the piston. In many hours of tests with a pumping mechanism constructed in accordance with this invention, there was developed no physical indication of any impacting contact between the piston and discharge valve.

As the piston 38 moves downwardly during its inlet stroke from the top dead center position shown in FIG. 7, the compression spring 84 drives the spool element 72 downwardly and thus also moves the discharge valve 90 downwardly toward its seated relationship with the seat surface 94. At the same time, assuming that the annular sealing element 104 has been compressed as the result of the compression stroke of the piston and discharge valve, it will then expand, thereby also developing a force that drives the discharge valve 90 downwardly. As soon as the discharge valve 90 becomes seated against the seat surface 94, the inlet stroke of the pumping mechanism will be initiated with further downward movement of the piston causing opening of the inlet valve 114 in the manner illustrated in FIG. 4.

Although the gas pumping mechanism has been described heretofore with the inlet stroke being controlled by means of a poppet type inlet valve as shown at 114 in the preceeding figures, it is not intended to limit the present invention solely to pumping mechanisms incorporating poppet valves. In the manner illustrated in FIG. 8, it is evident that a gas pumping mechanism incorporating a reed type inlet valve may also be effectively employed within the spirit and scope of this invention. As shown in FIG. 8, a pumping mechanism is illustrated generally at 140 incorporating a pump body 142 having a pump cylinder 144 that receives a piston 146 in the same manner as described above in connection with FIGS. 1–7. The upper extremity of the pump body 142 is formed to define a planar surface 148 having a pump head structure 150 interconnected therewith in any suitable manner. Immediately about the piston bore 144 there is defined an annular seat surface 152 against which the periphery of a discharge valve 154 is adapted to become seated in the closed position thereof. The lower portion of the discharge valve is formed to define a central inlet valve recess 156 with a plurality of inlet passages 158 being formed in the central portion of the discharge valve and communicating with the recess 156. A reed valve 160 is positioned within the recess 156 with the central portion thereof being formed for mating, retained engagement with a retainer head portion 162 of a retainer bolt 164. A lock nut assembly 166 functions to lock the retainer bolt 164 in positively retained assembly with the central portion of the discharge valve. The lower portion of the discharge valve, the lower portion of the reed valve, and the lower surface of the head 162 of retainer bolt 164 are all of coplanar interfitting configuration, thus preventing the development of any undesirable spaces that might provide reexpansion of a substantial volume of compressed gas. Regardless of the characteristics of the discharge and inlet valves, it is intended that virtually no reexpansion space be developed which might otherwise interfere with the volumetric efficiency of the pumping mechanism. The outer peripheral portion of the reed valve 160 is of flexible nature and, upon development of a vacuum condition within the pump cylinder 144, the reed valve 160 will be opened by differential pressure thereby allowing inlet of ambient gas into the cylinder for subsequent compression. Piston movement during the compression stroke will develop a pressure condition within the cylinder which acts upon the reed valve 160 causing it to become tightly closed. The inherent spring characteristics of the reed valve will cause the reed valve to close under ordinary ambient conditions.

FIG. 9 is a mechanical illustration of the self-centering and seating chacteristics of the discharge valve under circumstances where the bore defining the spool receptacle is misaligned with respect to the center line of the bore defined in the pump body. In the case of FIG. 9, misalignment is exaggerated in order that the nature of this phenomenon will be more readily understood. In this case, the piston bore 36 is shown to be formed in precisely normal relation with respect to the planar surface 46 that also defines the discharge valve seat. In the pump head structure, however, the blind bore 64 that defines the spool receptacle is so formed that the axis or center line 170 thereof is disposed in angular relation with respect to the center line 172 of the piston bore. Thus, the center line 170 of the spool 72 is misaligned with respect to the center line 172 of the piston bore and thus the spool is also misaligned with respect to the planar surface 46 of the pump body. As mentioned above, the annular sealing element 104 is capable of being compressed on one side thereof to a greater extent as compared to the opposite side and yet maintain optimum sealing between the discharge valve and spool. As shown in FIG. 9, sealing element 104 maintains its sealed relationship with respect to the discharge valve and spool while at the same time seeking optimum seating relationship with the annular seat surface 94 defined by the inner periphery of planar surface 46 of the pump body. In the past, pump mechanisms of this general nature have required precise registry of the center lines of the discharge valve receptacle of the pump head structure and the piston bore in the pump body. This requirement made extremely accurate machining necessary thereby materially enhancing the cost of the pump mechanism involved and yet resulting in a pump mechanism that typically required hand lapping and other extremely expensive manufacturing processes to yield a pump mechanism of operative nature. Further, pump mechanisms of this general nature were difficult to maintain and service and for all of these reasons, were generally unsatisfactory for the purposes intended. In view of the wide latitude of manufacturing control and tolerances that are promoted by the present invention, the efficient pumping capability thereof may be effectively obtained without materially enhancing the cost of the product in the manufacturing process thereof. Moreover, the pump mechanism of this invention is of extremely simple nature and is capable of being serviced in the field in the event servicing becomes necessary.

Figure 3:
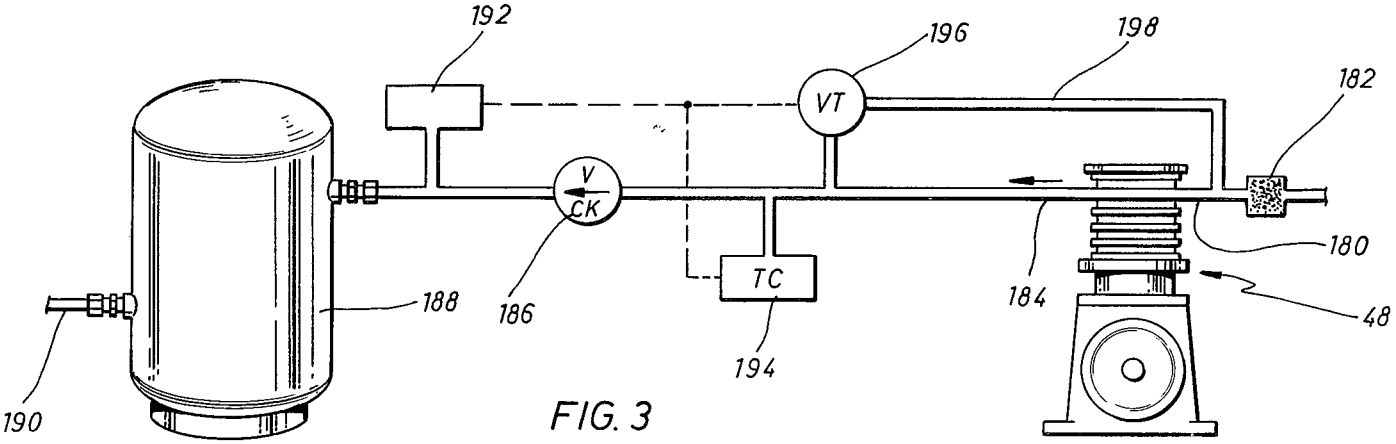

While pump mechanisms illustrated generally in FIGS. 1–9 are acceptable for gas pumping mechanisms of general nature under circumstances where high volume pumping capability is required, it is typically desirable that gas pumping systems incorporated unloading features in order that the power systems therefore may operate continuously and need not start under pressure. Further, the pumping mechanisms may be designed to pump continuously with reduced gas volume or zero gas volume, when unloaded. Accordingly, a pressure controlled system for unloading is illustrated in FIG. 3 while a mechanical unloading mechanism is illustrated in FIG. 10. Referring now particularly to FIG. 3, the pump mechanism illustrated generally at 48 and which may conveniently take the form illustrated in FIGS.

1–9, incorporates a suction conduit 180 having an inlet filter 182 through which ambient gas is drawn into the pumping mechanism. A pump discharge conduit 184 conducts compressed gas from the pump mechanism across a check valve 186 to a suitable storage vessel 188 having a discharge connection 190 that conducts the compressed gas from the vessel 188 to a suitable site where work is done. The discharge conduit 184 is in communication with a pressure sensor 192 and a throttle control 194 and with a throttle controlled valve 196. Upon sensing of a predetermined maximum pressure by pressure sensor 192, appropriate signals are transmitted to the throttle control and throttle controlled valve as shown by the broken lines which has the effect of shifting the throttle of the power system for the pump to a reduced speed position thereof and simultaneously opening the throttle controlled valve 196 of a bypass circuit 198 interconnecting the inlet and discharge conduits of the pump. With the throttle controlled valve 196 in the open position, the pump 48 continues to operate, but operates at reduced pumping condition by virtue of the throttle control 194. The gas pumped simply circulates from the discharge conduit into the bypass conduit through the opened throttle control valve. As the demand for additional compressed gas occurs, the discharge pressure sensor 192 will initiate an appropriate signal that will be transmitted to the throttle control 194 and to the throttle controlled valve 196. The valve 196 will then move to its closed position and the throttle control will shift the pump energizing motor from its reduced condition to a power condition. Pressurized gas is then discharged through conduit 184 and traverses the check valve 186 to the supply vessel 188. Thus, the pumping mechanism is allowed to continuously operate and the motor powering it is operated at reduced load and at constant speed and thus the energy required for operation is lessened. Also, the motor may be of nominal size without detracting from the operational or functional capability of the pumping mechanism.

Referring now to FIG. 10, there is shown an embodiment of this invention wherein mechanical unloading is employed. In a pump 48 which may be constructed essentially identical to the pump structure of FIGS. 1–9, an inlet valve structure may be provided having a poppet valve plate portion 114, operating stem 116 and compression spring 124 of similar construction as compared to the above-mentioned figures. In the case of mechanical unloading, however, the inlet valve may incorporate a valve unloading extension 200 that is disposed for contact with a valve operating extremity 202 of an operating rod 204. The operating rod may be interconnected by means of a pivot 206 to a projection 208 within the inlet passage 67. The opposite extremity of the operating rod 204 may be formed to define a connection structure 210 that may be interconnected in cooperative relation with the throttle control system of the motor having driving interconnection with the pump structure 48. A pressure sensor similar to that at 192 of FIG. 3 will transmit an appropriate signal to a throttle control mechanism 194 and the throttle control mechanism will induce simultaneous actuation of the throttling portion of the drive motor for the pump and the operating system for the inlet valve. When the motor is shifted to its reduced speed condition, the operating rod 204 will be moved upwardly about its pivot 206, thereby causing downward movement of the valve controlling extremity 202 thus shifting the inlet valve to its open position. In the open position of the inlet valve movement of the piston in either direction will simply cause movement of gas in the inlet passage and chamber portions of the pumping mechanism. There will be no compression of gas within the cylinder and thus no opening of the discharge valve 90 of the pump.

In the case of mechanical suction unloading of this nature, it will be necessary to adjust the stroke of the piston to insure that it does not come into contact with the inlet valve 114 when the inlet valve is maintained open by the operating rod 204. Otherwise, the inlet valve piston or both may be damaged by impact between the inlet valve and piston.

Suction unloading may also be accomplished by preventing sealing of the discharge valve as illustrated in FIG. 12. In this alternative embodiment, the stem 220 of the inlet valve 222 is formed to define an elongated opening 224 that forms a part of a lost-motion connection shown generally at 226. A suction control stem 228 is provided with a connection element 230 that is received within the elongated opening. The elongated opening is of sufficient length that the inlet valve stem is allowed to move freely to the fuller extent of its travel without any interference by the control stem. When suction unloading is desired, the control stem is moved upwardly to a position where the connection element restrains both the inlet and discharge valves from sufficient downward movement to cause seating of the discharge valve. The suction control stem may extend through the spool and head plate as shown and may be sealed with respect to each by means of O-ring seals 232 and 234. A stem actuator 236 which may be solenoid energized or energized in any other suitable manner, is employed to impart controlling movement to the suction control stem. As a further alternative, the control stem may be fixed with respect to the spool and the spool may be controllably moved linearly to a position that takes up the lost-motion and maintains the discharge valve in a nonsealing position.

In another alternative, suction unloading may take the form illustrated schematically in FIG. 12 where the head structure is formed to define a suction unloading passage that is identified schematically by line 231 which communicates the inlet passage 67 with a portion 233 of the discharge chamber. A suction unloading valve 235, which may be a spool valve or a valve of any other suitable form, is interconnected within the passage 231. A valve actuator 237, such as a solenoid actuator similar to that shown at 236, is operative to open or close the valve 235, thus controlling suction unloading. With valve 235 closed, the pump mechanism pumps normally, but with valve 235 open, the inlet and discharge of the pump mechanism are communicated and pumping ceases even though the piston continues to reciprocate.

It is evident that the O-ring type sealing members 74 and 76 must maintain sealing engagement with respective sealing surfaces 68 and 70 as the spool element 72 moves within its receptacle during pumping operations. In order to prevent sliding of the sealing members 74 and 76 against the respective sealing surfaces and to minimize wear of the sealing members as well as minimize any interference that might occur due to frictional sliding of the sealing members on the sealing surfaces, each of the sealing elements may take the convenient form illustrated in FIG. 11. As shown in the fragmentary sectional view of FIG. 11, the annular seal grooves, one of which is shown at 219, are of significant depth that the annular sealing element 74 has a slightly greater cross-sectional dimension as the depth of the seal groove and thus the sealing element is slightly compressed between the outer annular surface 221 of the seal groove and the cylindrical surface 68 of the head structure 54. The seal groove 219, however, is formed such that the axial length thereof is significantly greater than the diameter of the sealing element 74. Thus, as the spool 72 moves relative to the head structure 54, the sealing element will roll rather than slide with respect to the annular surfaces 68 and 221. Movement of the spool element 72 in the direction of the arrow in FIG. 11 will cause rotation of the sealing element in the direction of the curved arrow shown therein. Logically, movement of the spool in the opposite direction will cause opposite rotational or rolling movement of the sealing element. Thus, the sealing element is allowed to maintain efficient sealing contact between the cylindrical surfaces 68 and 221 as the spool element moves in either axial direction thereof. Since spool movement is relatively small, the width of the seal groove 219 need only be sufficiently great to allow free rolling of the sealing element to occur without necessarily coming into contact with the shoulder or abutment surfaces 223 and 225 that define the opposed axial extremities of the seal groove. Since the annular sealing element is subject to a rolling rather than sliding activity, very little seal wear occurs as the spool element reciprocates during pumping activity. The effective service life of the sealing element is therefore materially extended as compared to sliding O-ring type sealing elements and therefore minimal servicing of the pumping mechanism will be required.

It is not intended that this invention be restricted to the O-ring type seals shown in the drawings. For example, metal bellows or other metal diaphragms may be employed to establish a seal between the spool and head and yet allow linear reciprocation of the spool. Other sealing devices such as sliding seals may also be utilized in place of the O-ring type seals.

In view of the foregoing, it is clear that the present invention provides a novel gas pumping mechanism that is effectively enabled to pump in different kinds of gaseous environment within the spirit and scope hereof. For example, the pumping mechanism will function efficiently as a compressor in order to compress air for compressed air requirements, to compress natural gas for gas transmission and to pump liquifiable gas such as freon for aid conditioning and refrigeration systems. The gas pumping mechanism is also capable of functioning as a heat pump compressor for maintaining optimum temperatures within buildings during all seasons of the year and is further capable of functioning in vacuum pumps to satisfy a wide variety of vacuum requirements. Regardless of the use thereof in vacuum or positive pressure pumping conditions, the piston and novel valve arrangement accomplishes complete discharge of all of the gas from the cylinder during each compression stroke and leaves no residual gas for reexpansion during the inlet stroke. Thus, the volumetric efficiency of the pumping mechanism remains exceptional regardless of the characteristics of the pumping operation involved.

The pumping mechanism of this invention is relatively simple to manufacture because it requires only ordinary manufacturing tolerances and thus minimizes the cost of manufacture. Moreover, the simplicity of this pumping mechanism allows gas pumping to be accomplished for extremely long periods of time without any exceptional requirements for repair or maintenance.

The pumping mechanism of this invention reflects extremely efficient use of energy. It has been determined through tests that energy savings in the range of 10% to 36% are effectively achieved through utilization of this pumping mechanism in conjunction with air compression. Efficient operation and exceptional energy savings will be possible in all fields of gas compression including the vapor compression of fluids such as freon for refrigeration and liquified gas.

Through incorporation of a self-centering type discharge valve and a discharge valve incorporating an inlet valve therein, the pumping mechanism may be manufactured of very simple nature and yet the discharge valve will be capable of establishing a proper sealed relationship with respect to a valve seat surrounding the entire circumference of the pump cylinder. Moreover, the discharge valve will have a pivotal capability with respect to the valve controlled spool with the pivot thereof being disposed in close proximity to the plane of sealing relationship with the pump body. This feature allows the discharge valve to readily seek optimum sealing relationship with respect to the pump body and to be free for any lateral shifting that might be appropriate to enabling the optimum sealing relationship to be developed.

The valve control spool is typically of pressure balanced nature for general pumping operations, but, where appropriate, may be rendered unbalanced in either selected axial direction thereby rendering the pumping operations subject to a certain degree of design that enhances operation at specific pressure ranges or to render the valve control spool responsive only to pressure conditions in absence of a compression spring or other mechanical control. By either pressure balancing the spool or by rendering it unbalanced to a controlled degree, the opening characteristics of the discharge valve may be effectively controlled and opening may be accelerated or delayed as desired to increase the pumping capability or operational characteristics.

The pumping mechanism of this invention is efficiently structured for high speed operation, primarily because of the fact that minimal discharge valve movement is required in order to move the discharge valve from the closed position to the fully open position. The pumping mechanism is efficiently designed for utilization in simple compressor structures, or, in the alternative, for use under circumstances where unloading systems are required for high volume pumping conditions.

In view of the foregoing, it is apparent that the present invention is adapted to attain all of the objects and features hereinabove set forth, together with other features that are inherent from the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit and scope thereof. It is to be understood that all matters hereinabove set forth or shown in the accompanying drawings are to be interpreted as illustrative and not in any limiting sense.

What is claimed is:

1. A piston pump mechanism for positive gas pressure and vacuum pumping operations, said piston pump mechanism comprising:

pump body means defining cylinder means therein, said pump body means defining seat means circumscribing said cylinder means and further defining discharge chamber means surrounding said seat means;

a pump head being affixed to said pump body means and cooperating therewith to define a discharge chamber surrounding said seat means and defining an inlet chamber;

piston means being movably disposed within said cylinder means;

means for imparting reciprocating movement to said piston means within said cylinder means;

discharge valve means defining sealing surface means, said sealing surface means adapted to establish sealing engagement with said seat means said discharge valve means being movable to the open position thereof by gas pressure within said cylinder to allow discharge of gas from cylinder means into said discharge chamber means and being moved to the closed position thereof by at least one of gas pressure within said discharge chamber means and mechanical urging means;

inlet valve means being defined in said discharge valve means and communicating with said cylinder means and with said inlet chamber, said inlet valve means adapted to open responsive to negative pressure within said cylinder means to allow inlet of gas into said cylinder and adapted to close responsive to positive gas pressure within said cylinder means to allow compression of gas within said cylinder;

valve control spool means being movably positioned within said pump head; and location control means being interposed between said spool means and discharge valve means, said location control means providing lateral and pivotal control for said discharge valve and defining omnidirectional pivot means allowing pivoting of said discharge valve to accommodate seat and head misalignment.

2. A piston pump mechanism as recited in claim 1, wherein:

mechanical urging means urges said spool means toward said discharge valve means and urges said discharge valve means into sealing engagement with said valve seat means except during discharge pressure induced unseating of said discharge valve means.

3. A piston pump mechanism as recited in claim 1, wherein:

said discharge valve is generally in the form of a plate;

said inlet valve is a poppet valve being attached to said discharge valve; and spring means urges said inlet valve toward the closed position thereof.

4. A piston pump mechanism as recited in claim 1, wherein:

said discharge valve is of generally plate-like configuration; and said inlet valve is a reed valve having a part thereof secured to said discharge valve, said reed valve being opened and closed responsive to differential gas pressure.

5. A piston pump mechanism as recited in claim 1, wherein:

said cylinder defines a plane at the intersection thereof with said valve seat, said valve seat being of generally circular form and lying substantially in said plane;

said piston defines an end wall opposing said discharge valve, during compression movement of said piston said end wall moving past said plane to a position beyond said plane at the top dead center position of said piston.

6. A piston pump mechanism as recited in claim 5, wherein:

said discharge valve and piston end wall are of mating configuration; and a cushion of compressed gas develops between said end wall of said piston and said discharge valve and functions to prevent actual contact therebetween during compression and discharge of all of the gas from said cylinder into said discharge chamber.

7. A piston pump mechanism as recited in claim 6, wherein:

said discharge valve moves toward said valve seat along with said end wall of said piston, upon contact of said discharge valve with said valve seat, said inlet valve is opened by negative pressure in said cylinder caused by continued intake movement of said piston.

8. A piston pump mechanism as recited in claim 1, wherein:

said pump head is formed to define spool passage means interconnecting said discharge chamber and said inlet chamber; and said valve control spool means being movably received within said spool passage means and being sealed with respect to said passage means to prevent communication between said inlet and discharge chambers, said spool means being formed to define inlet passage means communicating said inlet chamber with said inlet valve.

9. A piston pump mechanism as recited in claim 8, wherein:

discharge pressure passage means are provided for said spool means whereby said spool means is substantially balanced by discharge pressure acting thereon.

10. A piston pump mechanism as recited in claim 8, wherein:

said spool passage means is formed to define annular spaced sealing area means positioned on either side of said inlet chamber; and spaced annular seal means establishes seals between said spool means and said sealing area means of said pump head on either side of said inlet chamber.

11. A piston pump mechanism as recited in claim 10, wherein:

said annular seal means accomplishes centering of said spool means within said spool passage means and prevents contact between said spool means and the wall of said spool passage means.

12. A piston pump mechanism as recited in claim 10, wherein:

said annular means establish seal area means of substantially identical cross-sectional area; and means communicating discharge pressure to each of said cross-sectional areas and causing pressure induced forces acting on said spool to be substantially balanced.

13. A piston pump mechanism as recited in claim 10, wherein:

said seals and seal means are of differing cross-sectional area; and means communicating discharge pressure to each of said cross-sectional areas and developing a resultant force acting upon said spool means and urging said spool means in a selected direction relative to said discharge valve.

14. A piston pump mechanism as recited in claim 1, wherein said location control means comprises:

first annular sealing surface means being defined at one extremity of said spool means;

second annular sealing surface means being defined by said discharge valve; and an annular sealing element formed of elastomeric material being received in sealing contact with said first and second annular sealing surface means, said elastomeric sealing element establishing a seal between said spool element and said discharge valve element and orienting said discharge valve laterally with respect to said valve seat, said annular sealing element further defining an annular pivot at any point thereabout to facilitate precise sealing orientation of said discharge valve relative to said valve seat.

15. A piston pump mechanism as recited in claim 14, wherein:

one extremity of said spool means is formed to define an annular rim forming said first sealing surface means, said annular rim cooperating with said one extremity of said spool means to define an annular seal receptacle; and said annular sealing element being an elastomeric O-ring and, when seated in said seal receptacle, being in engagement with said one extremity of said spool means and said annular rim.

16. A pump head mechanism for piston pumps adapted for positive gas pressure and vacuum pumping operations and incorporating a pump body defining piston containing cylinder means and seat means about said cylinder means, said pump head mechanism comprising:

a head structure adapted to be secured in fixed relation to a pump body, said head structure defining an inlet chamber and a discharge chamber, said head structure being further formed to define a spool cavity intersecting said inlet and discharge chambers and to define pressure balancing passage means in communication with said discharge chamber;

a discharge valve being received within said discharge chamber and defining a circular sealing surface adapted to establish sealing engagement with a seat surface defined about the cylinder of a pump body, said discharge valve defining first sealing surface means;

a spool element being movably received within said spool cavity, said spool element defining inlet passage means, said spool element cooperating with said head structure within said cavity to define a pressure balancing chamber, said pressure balancing chamber being in communication with said pressure balancing passage means, said spool element defining second sealing surface means;

first seal means sealing said spool element with respect to said head structure and sealing communication between said inlet and discharge chambers; in inlet valve being provided in said discharge valve;

means sealing said discharge valve with respect to said spool and sealing said inlet passage means with respect to said discharge chamber;

a compression spring being disposed within said cavity and urging said spool toward said discharge valve, whereby said discharge valve is seated responsive to the spring force thereof when balanced pressure conditions exist across said discharge valve; and second seal means establishing sealing engagement with said first and second sealing surface means and permitting angular movement of said discharge valve relative to said spool element to permit said discharge valve to seek optimum sealing engagement with said seat surface.

17. A pump head mechanism as recited in claim 16, wherein:

said discharge valve is movable laterally, linearly and pivotally with respect to said head structure and spool element, thereby allowing said discharge valve to compensate for any misalignment of said seat means relative to the axis of said spool cavity and seek optimum sealing engagement with said seat means of said pump body.

18. A pump head mechanism as recited in claim 16, wherein said pump head includes:

an annular seal receptacle being defined at one extremity of said spool element and defining said second sealing surface means;

annular shoulder means being defined by said discharge valve and defining said first sealing surface means; and said second seal means being an annular sealing element formed of elastomeric material being received within said annular seal receptacle and about said annular shoulder means, said elastomeric sealing element establishing a seal between said spool element and said discharge valve element and orienting said discharge valve laterally with respect to said valve seat, said annular sealing element further defining an annular pivot at any point thereabout to facilitate pivotal orientation of said discharge valve relative to said valve seat.

19. A pump head mechanism as recited in claim 18, wherein:

one extremity of said spool element is formed to define an annular rim, said annular rim cooperating with said one extremity of said spool element to define said annular seal receptacle; and said annular sealing element is an elastomeric O-ring and, when seated in said seal receptacle, being in engagement with said one extremity of said spool element and said annular rim.

20. A pump head mechanism as recited in claim 16, wherein:

suction unloading means is interconnected with said pump head and is selectively operative to prevent pumping during reciprocation of said piston.

21. A pump head mechanism as recited in claim 20, wherein said suction unloading means comprises:

a suction unloading stem;

means interconnecting said suction unloading stem with said discharge valve means and allowing unrestricted movement of said discharge valve means during normal operation; and stem actuator means being interconnected with said suction unloading stem and being selectively operative to maintain said suction unloading stem and discharge valve means in a position preventing sealing of said discharge valve means.

22. A pump head mechanism as recited in claim 20, wherein said suction unloading means comprises:

suction unloading passage means formed in said head and interconnecting said inlet means and discharge chamber means;

suction unloading valve means being interconnected with said suction unloading passage means and being operative to control communication of said inlet means and said discharge chamber means; and actuator means being interconnected with said suction unloading valve means and causing selective opening and closing of said suction unloading valve means.

23. A pump head mechanism for piston pumps defining a pump body having pump cylinder means and seat means defined about said cylinder means and wherein said piston pumps are adapted for positive gas pressure and vacuum pumping operations, said pump head mechanism comprising:

a head structure adapted to be secured in fixed relation to said pump body and defining discharge chamber means, valve chamber means and spool cavity means therein;

a discharge valve being movably received within said valve chamber means and adapted to establish a seal about the entier periphery of said cylinder bore of said pump body;

a discharge valve control spool means being positioned for reciprocal movement within said spool cavity means;

elastomeric sealing means establishing omnidirectional interengagement and sealing between said discharge valve control spool means and said discharge valve and permitting said discharge valve to float within said valve chamber and establish optimum sealing engagement about said cylinder bore; and spring means urging said discharge valve control spool means and said discharge valve toward the sealing position of said discharge valve.

24. A pump head mechanism as recited in claim 23, wherein said elastomeric sealing means comprises:

an O-ring seal establishing an annular seal with said discharge valve control means and said discharge valve, said O-ring seal means sealing against inlet and discharge pressures.

25. A pump head mechanism as recited in claim 23, including:

pressure balancing means causing pressure balancing of said discharge valve control spool means and discharge valve, whereby said discharge valve control spool means and said discharge valve are urged solely by said urging means.

26. A pump head mechanism as recited in claim 25, wherein:

said urging means comprises a compression spring of small force magnitude.

27. A pump head mechanism as recited in claim 23, wherein:

said discharge valve defines 360° sealing surface means at the outer periphery thereof adapted for sealing engagement with said seat means;

means pressure balancing said discharge valve upon opening thereof; and said urging means being a small force magnitude compression spring applying sole closing force to said discharge valve during closing movement thereof.

28. A pump head mechanism as recited in claim 27, wherein:

said discharge valve is of substantially plate-like configuration and is of low inertia characteristics facilitating quick response thereof to opening and closing forces.

29. A pump head mechanism as recited in claim 28, wherein:

said pump head is formed to define a generally cylindrical spool receptacle therein;

said discharge valve control spool means is movably received within said spool receptacle;

seal means sealing said spool means with respect to said spool receptacle and maintaining said spool means in spaced and centered relation with pump head surface means defining said spool receptacle; and said means establishing said omnidirectional interengagement comprises annular elastomeric sealing means interposed between said spool means and said discharge valve and establishing sealing engagement with said spool means and said discharge valve.

* * * * *